US005785201A

United States Patent [19]

Bordner et al.

[11] Patent Number: 5,785,201

[45] Date of Patent: Jul. 28, 1998

[54] MOLDED LID WITH WAVE CONFIGURED CENTRAL PORTION

[75] Inventors: Paul G. Bordner, Pickerington, Ohio; Richard P. Brandt, Crystal Lake, Ill.

[73] Assignee: Container Accessories, Inc., Gahanna, Ohio

[21] Appl. No.: 643,236

[22] Filed: May 2, 1996

[51] Int. Cl.[6] ..... B65D 45/34

[52] U.S. Cl. ..... 220/321; 220/254; 220/601; 220/624; 220/806; 206/508

[58] Field of Search ..... 220/319, 320, 220/321, 254, 601, 623, 624, 806; 206/508

[56] References Cited

U.S. PATENT DOCUMENTS

| | | | |
|---|---|---|---|
| 3,070,257 | 12/1962 | Bojanowski | 206/508 |
| 3,276,657 | 10/1966 | Speas | 206/508 |
| 3,677,430 | 7/1972 | Yates, Jr. | 206/508 X |
| 4,130,535 | 12/1978 | Coran et al. . | |
| 4,177,934 | 12/1979 | Hammes et al. | 220/319 |
| 4,500,010 | 2/1985 | Schutz | 220/320 |
| 4,718,571 | 1/1988 | Bordner . | |
| 4,767,021 | 8/1988 | Pies | 220/465 |
| 4,898,760 | 2/1990 | Halberstadt et al. . | |
| 5,070,111 | 12/1991 | Dumbauld . | |
| 5,129,537 | 7/1992 | Bordner et al. . | |
| 5,184,751 | 2/1993 | Middleton | 220/694 |
| 5,192,586 | 3/1993 | Mertinooke et al. . | |
| 5,361,928 | 11/1994 | Stolzman | 220/378 |
| 5,393,796 | 2/1995 | Halberstadt et al. . | |
| 5,568,876 | 10/1996 | Schutz | 220/254 |

OTHER PUBLICATIONS

Lobo Containers, Inc. "The Lone Wolf in X Rated Drums" Brochure. Date unknown.

*Primary Examiner*—Stephen Cronin
*Attorney, Agent, or Firm*—Mueller and Smith, LPA

[57] ABSTRACT

A molded lid having an intermediate region configured as a sequence of waves, each of curved cross-section forming successively occurring crests and troughs, and exhibiting amplitudes increasing in value from the lid center toward the rim. The waves terminate at a ring band which is located to slide in adjacency with the inwardly disposed side of a plastic drum. The lid is provided with a polymeric gasket which is retained in position by a retainer band which is insertable in sliding compressive engagement within a retainer cavity.

19 Claims, 8 Drawing Sheets

MOLDED LID WITH WAVE CONFIGURED CENTRAL PORTION

BACKGROUND OF THE INVENTION

Cylindrical containers intended for retaining chemicals, industrial materials, and the like, when configured in larger, drum sizes generally are structured either of a metal such as steel or, particularly in North America, of a fiber material. Such fiber drums are formed having a metal chime and a replaceable lid which typically is retained in position by a split ring clamp. Other regions of the globe, particularly Europe and the Far East, form such non-metallic varieties of drums of a plastic rather than fibrous material. With the rapid globalization of commerce, a trend toward a somewhat universal use of plastic material for fabricating drums and associated lids has been observed. In this regard, there are ecological advantages associated with such uses of plastic, the material forming the drums and lids, for the most part, being recoverable. International standards also are developing which may supplant national standards for the performance of these drums. From a national standpoint, the United States Department of Transportation (DOT), Research and Special Programs Administration, promulgate specifications for drum performance. See generally 49 CFR Ch. (Oct. 1, 1988 Ed.), Sec. 178.244–2. Standards also have been promulgated by the United Nations organization. DOT standards typically call for drop tests wherein the drums are filled with dry, finely powdered material to an authorized net weight and closed with a lid. Depending upon the standards involved, the containers then are called upon to withstand a drop from varying heights and orientations onto a hard surface such as concrete. To pass such tests or standards, the drum and lid combinations must recover from such drops without rupture or leakage. One international test approach involves a similar drop test except that the drums are filled with water instead of powdered materials. Such tests also include a seal test wherein the drums are filled with water and up-ended to determine the presence of leakage.

Lids typically enclosing the drums are formed as stamped metal or plastic components which are secured over the rim-chime assemblies with metal split ring clamps having a channel or U-shaped cross section, the lower inwardly turned side or edge of which engages a rim or groove of the lid-drum interface and the upper side of which abuts over the lid top. An over-center lever generally is used to draw the ends of the split ring clamp structure together. For many packaging, transportation, and incinerator container applications, industrial users of such strucures have sought to avoid metal components such as lids and lid retainers including the split ring clamping device. These metal devices do not burn, are prone to corrode, or, importantly, to insert minute metallic contaminants with the material packaged within the containers. Plastic lids have been successfully developed, for example as described in U.S. Pat. No. 4,718,571, by Bordner and for some period of time, the development of corresponding plastic clamping rings which remain competitive in terms of cost and securement performance was an elusive objective for investigators, until Bordner, et al., evolved a successful all plastic polymeric two-piece split ring clamp. This clamp, which found success in conjunction with fiber type drums, is described in U.S. Pat. No. 5,129,537, issued Jul. 14, 1992, and entitled "Two-Piece Polymeric Lid Clamping Ring".

The plastic lids and split ring clamps heretofore developed have performed quite well in combination with inherently rigid fiber drums. However, their experimental application to plastic drums has demonstrated a need for greater strength. An improved, two piece polymeric split ring clamp suited for use with the all plastic container combination is described in co-pending application for United States patent entitled "Polyermic Split Ring Clamp" by Bordner, et al., filed May 2, 1996, Ser. No. 08/643,249. Improvements in plastic lids have been achieved through the incorporation therein of peripherally disposed, integrally formed plastic gusseting. However, additional improvements in strengthening these lids for the all plastic combination will be desirable.

Another important aspect of the all plastic container system resides in their reusability. Inasmuch as the drums are formed entirely of polymeric material, they may be cleaned and reused to achieve a substantial financial savings. However, this economically desirable reusability feature has not been available in the case of lids. To be practically cleanable utilizing automated scrubbing systems, crevices or like geometric configurations which would require manual cleaning procedures should be avoided. Otherwise, the cleaning cost renders the reuse feature unfeasible. Another block to lid reusability or reconditioning has been associated with the removal of the polymeric gasket functioning as a seal between the lid and an associated drum. Traditionally, this gasket has been formed of polyurethane which is fabricated in situ within the lid rim structure. Because of its adherence to the lid, the removal of such gaskets as a part of a cleaning process has been impractical to further defeat the otherwise desirable attainment of a reusable lid.

SUMMARY

The present invention is addressed to a molded plastic lid suited for closure, inter alia, over molded plastic drums. Enhanced strength for this application is achieved through a structure wherein the central or intermediate region of the lid is configured as a sequence of waves which extend with gradually increasing amplitude from the lid center to a peripheral ring band. That ring band nests against the inside wall of the top portion of an associated drum when the lid is installed in closing relationship over it. For plastic drum applications, the geometry substantially improves the structural integrity of the lid drum combination.

Another feature of the geometry of the molded lid of the invention, which enhances its structural integrity, resides in the fashioning of its intermediate or center portion in a manner wherein the wave crest edges define a shallow dome. For example, this shallow dome may describe an Arc having a radius of about 200 inches. In contrast, an arc also is defined along the lower edges of the trough portions of the central region, such Arc being associated with a radius of much smaller extent.

The smoothly transitioning crest-trough geometry of the lid also promotes its cleanability and thus, its practical reusability. To complement this cleanability feature of the configuration of the lid, its rim structure is fashioned in concert with a slidably installed and removable polymeric gasket. This feature is achieved by incorporating both a concave annular sealing cavity for nesting over the upstanding edge of the drum and also an adjacent retainer cavity. A polymeric gasket then is provided having a ring seal portion which is slidably insertable within that sealing cavity. The ring seal portion is extruded, for example, with a thermoplastic rubber exterior skin and an internally-dispose foamaceous material. A retainer band is affixed to the ring seal by coextrusion which is formed of a more stiff plastic material and which is configured to extend around and into a sliding compressive engagement within the retainer cavity. Small coextruded flexible fins formed, for example, of the noted thermoplastic rubber material are incorporated within the retainer band to provide a retention within the retainer cavity which is sufficient to retain the gasket in position but which is slidably removable. Preferably, the ring band also contains a flexible flap which is coextruded with it and formed of the noted flexible material which functions as a secondary seal for the drum lid system and also serves as contact for effecting removal of the gasket for purposes of cleaning the lid for reuse. The noted fins within the retainer cavity also have a self-cleaning aspect upon removal.

Another feature and object of the invention is the provision of a molded lid for a container having a top structure with an upwardly disposed edge and an inwardly disposed wall surface. The lid includes a lid top portion having a lid center axis and an intermediate region extending therefrom to an outer periphery locatable adjacent the container top structure. An annular rim structure is integrally formed with the top portion at the outer periphery, has a concave annular sealing cavity for receiving the container upwardly disposed edge in sealing relationship and has a ring band locatable in adjacency with the inwardly-disposed wall surface and extends downwardly therealong when the lid is positioned upon the container. The intermediate region is configured as a sequence of a predetermined number of waves, each of curved cross-section, and defining successively occurring crests and troughs exhibiting amplitudes therebetween increasing in amplitude value radially outwardly toward and having a predetermined maximum amplitude value at the ring band, the wave crests defining a shallow outwardly extending dome.

Another feature and object of the invention is to provide a molded lid for removable closure over a container having a top structure with an upwardly disposed edge. The lid includes a top portion having a lid center and an intermediate region extending therefrom to an outer periphery located adjacent the container top structure. An annular rim structure is integrally formed with the top portion at the outer periphery which includes an annular lid rim having a concave annular sealing cavity for receiving the container upwardly disposed edge in sealing relationship and a retainer cavity located in adjacency with the sealing cavity. A polymeric gasket having a ring seal portion is slidably insertable within the sealing cavity. A retainer band is fixed to the ring seal and is extensible in sliding, compressive engagement within the retainer cavity.

Another feature of the invention is to provide a molded lid for removable closure over a container having a top structure with an upwardly disposed edge and an inwardly disposed wall surface. The lid includes a lid top portion having a central region disposed about a lid center and an intermediate region extending therefrom to an outer periphery locatable adjacent the container top structure. An annular rim structure is integrally formed with the top portion at the outer periphery, having a ring band which is locatable in adjacency with the inwardly disposed wall surface of the container, and an annular lid rim with a concave annular sealing cavity for receiving the container upwardly disposed edge in sealing relationship. The rim structure also is formed having a retainer cavity located in adjacency with the sealing cavity. A polymeric gasket having a ring seal portion is slidably insertable within the sealing cavity. The gasket further includes a retainer band fixed to the ring seal and extensible in sliding, compressible engagement within the retainer cavity. The intermediate region of the lid is configured as a sequence of a predetermined number of waves, each of curved cross-section and defining successively occurring crests and troughs exhibiting amplitudes therebetween increasing in amplitude value radially outwardly from the lid center toward and having a predetermined maximum amplitude value at the rim band.

Since certain changes may be made in the above apparatus without departing from the scope of the invention herein involved, it is intended that all matter contained the above description or shown in the accompanying drawings shall be interpreted as illustrative and not in a limiting sense.

DETAILED DESCRIPTION

The molded lid to be described is particularly intended for use with an all plastic container system wherein an all plastic drum is combined with an all plastic lid and that lid is secured with an all plastic split ring clamp. To meet drop test criteria, greater lid resistance to impact occasioned distortion, inter alia, is called for. In the discourse to follow, the preferred embodiment of the molded lid structure of the invention is disclosed in and of itself, and as it cooperates with the noted plastic drum and split ring clamp. Then, a computer modeling of the lid is carried out and a comparison is made with a similar computer modeling of another all plastic acceptable lid.

Figure 1:
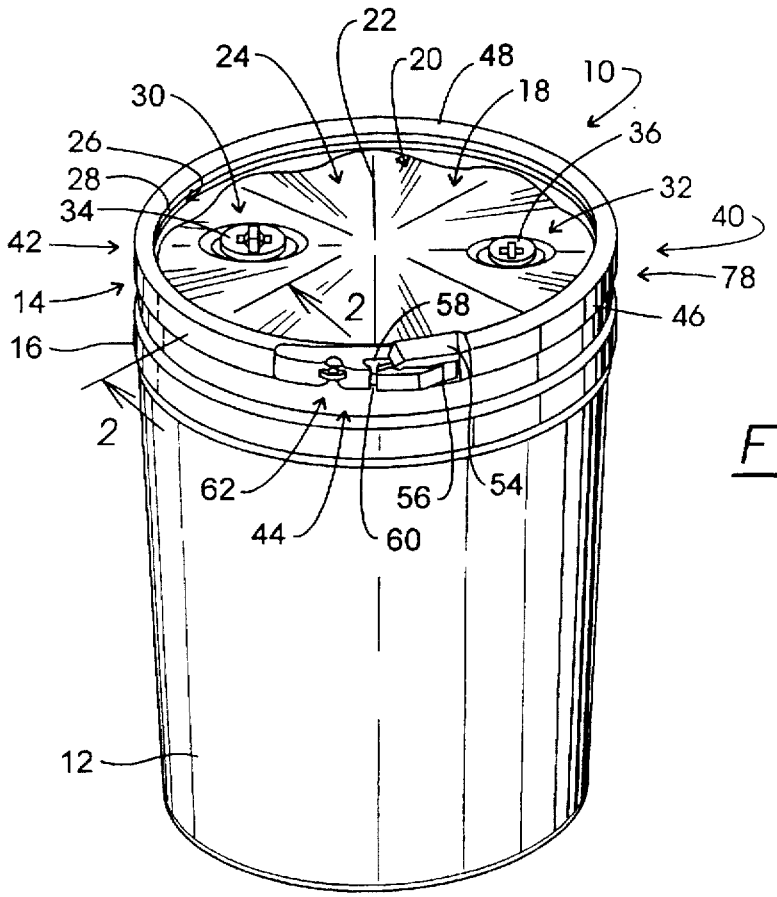
FIG. 1 is a perspective view of a drum and lid assembly incorporating a lid configured in accordance with the invention.

Looking to FIG. 1, a drum and lid assembly is represented generally at 10. The drum component of assembly 10 as shown at 12 typically will be blow molded or injection molded with a high density polyethylene, and configured such that the sidewalls slightly taper inwardly toward the drum bottom and the bottom surface is configured with a slight upward bow both to enhance seating of the drum on a surface and to avoid downward flexure. Upwardly, toward the top portion 14 of the drum 12, the sidewalls thereof are configured having an integrally formed, outwardly disposed truncated channel region 16 which strengthens, and thus enhances retention of the circular stature of its top structure 14. Generally, no metal chimes or the like as may be found with fiber drums are present in the plastic drum construction. Drum 12 is shown to be closed by a molded lid represented generally at 18. Lid 18 formed of a high density polyethylene, includes a top portion represented in general at 20 having a lid center 22 and an intermediate region 24 extending from the center to an outer periphery or annular rim structure represented in general at 26. The intermediate region 24 is configured as a sequence of a predetermined number of waves, each of curved cross section and defining successively occurring crests and troughs. These waves increase in amplitude from the lid center 22 toward the outer periphery 26. In the embodiment shown, eight such waves are depicted. Intermediate region 24 is seen to terminate at a ring band 28 within the outer periphery 26.

Diametrically oppositely disposed upon wave crests within the intermediate region 24 are two bung assemblies 30 and 32. Assemblies 30 and 32 are molded having threaded apertures extending through the lid top portion 20 and each receives a corresponding closing threaded fitnment respectively shown at 34 and 36. It is preferred that these bung assemblies 30 and 32 be positioned at a wave crest of the intermediate region 24, and this is achievable by having an even integer number of wave crests, for example eight. Typically, the bung assembly 30 has a nominal diameter of 2 inches while bung assembly 32 has a nominal diameter of about ¾ inch. Generally, the assemblies 30 and 32 serve the function, respectively, of filling or pouring and venting. Lid 18 may be fabricated with or without bung assemblies as determined by the user.

Lid 18 is secured to the top structure 14 of drum 12 by a two-piece split ring clamp represented generally at 40. Clamp 40 is formed of polymeric material, for example, a high molecular weight, high density polyethylene copolymer such as type HYA-24 marketed by Mobil Polymers U.S., Inc. The material exhibits excellent impact strength and stress crack resistance suited for high performance tank and drum applications. For added integrity and endurance under adverse sun conditions, the clamp, as well as lid and drum material may incorporate a U.V. (ultraviolet) screen.

In general, the clamp assembly 40 includes a ring shown generally at 42 and a pivot arm represented generally at 44. The latter pivot arm component 44 is configured both to exhibit an enhanced strength with respect to requisite international drop tests and the like as well as an enhanced profile. In the latter regard, the structure of the pivot arm is desirably conforming or thinner with respect to the outer periphery of the drum-lid assembly 10. The ring component 42 of the clamp 40 is configured having a generally channel-shape with an outwardly disposed band portion 46 along with oppositely disposed spaced sides seen in FIG. 2 at 48 and 50. To improve strength against flexure of ring 42, the center of band 46 may be formed with an enhanced thickness to define a ridge 52 seen in FIG. 2. Returning to FIG. 1, the ring 42 is seen to include an integrally formed receiver channel 54 having an opening formed therein as seen at 56. Pivot arm 44 includes a ring pivot shaft receiving notch 58 having an outwardly accessible shaft access opening 60. A locking detent assembly is shown generally at 62 which serves the purpose of retaining the pivot arm 44 in its closed orientation. The detent assembly 62 also is configured so as to receive a lock or the like to assure the integrity of the materials which may be contained in the drum and lid assembly 10.

Figure 2:
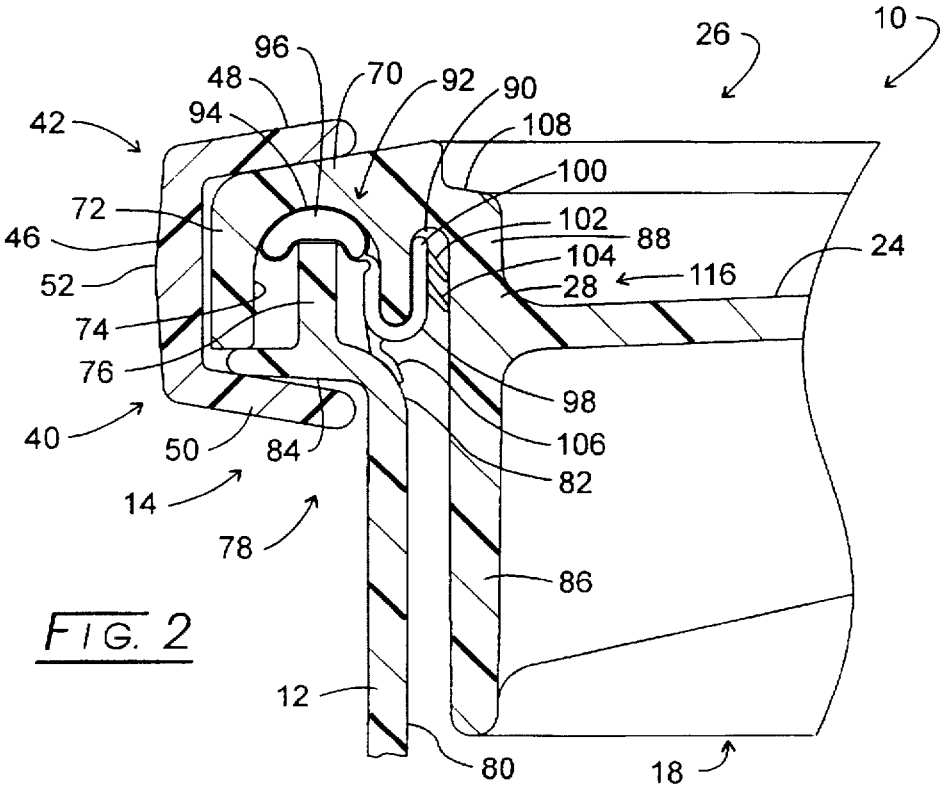
FIG. 2 is a partial sectional view taken through the plane 2—2 shown in FIG. 1.

FIG. 2 reveals the configuration of the upper portion of container 12 as it is associated with the outer periphery or annular rim structure 26 of the lid 18 and the split ring clamp 40. In the figure, the annular rim structure 26 is seen to include a lid rim 70 which includes a skirt portion 72 and provides an inwardly disposed annular sealing cavity 74. This cavity 74 is seen to be positionable over the upwardly disposed edge 76 of container 12. The upper portion 78 of container 12 is formed with an inwardly disposed surface 80 and which is formed to provide an annular ledge portion 82 which extends outwardly from the inner surface 80 to establish lower contact surface 84. Upwardly disposed edge 76 is seen to protrude upwardly from the ledge portion into the cavity 74.

Ring band 28 of lid rim structure 26 is seen to be slightly spaced from the container inner surface 80 and extends downwardly as at 86 as well as upwardly at 88. Adjacent to the sealing cavity 74 and positioned inwardly therefrom is an annular retainer cavity 90 which, in effect, is an extension of the gap between inner surface 80 of container 12 and ring band 28.

Figure 3:
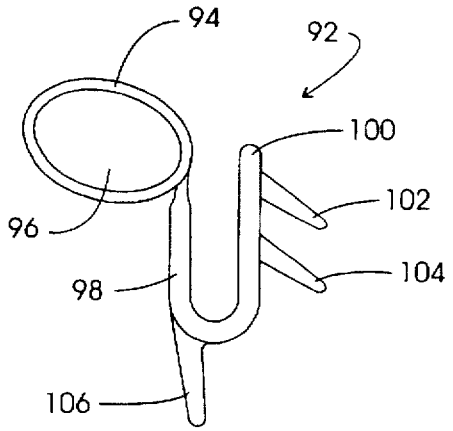
FIG. 3 is an end view of a removable polymeric gasket employed with the lid structure of the invention.

Sealing cavity 74 and retainer cavity 90 are configured to support a polymeric gasket represented generally at 92. This gasket 92 is configured so as to be readily removed from lid 18 such that the lid may be subjected to a cleaning process and then reused with the replacement and reinsertion of a new gasket 92. To achieve this, gasket 92 is configured as a coextruded structure, the end view of which is seen in FIG. 3. Looking additionally to that figure, the gasket 92 is formed having a ring seal portion 94 which is formed as an extruded thermoplastic rubber which is configured as a skin surmounting an inner cavity 96. The thermoplastic rubber may be provided, for example, as a material marketed under the trade designation "Vyram®" by Advanced Elastomer Systems, Inc. of Akron, Ohio. This flexible material is an elastomer which combines performance characteristics of vulcanized rubber, such as heat resistance and low compression set, with the processing ease of thermoplastics. Integrally formed by coextrusion with the ring seal portion 94 is a U-shaped retainer band 98 which is formed of a stiff polymeric material such as polypropylene or talc filled polypropylene. FIG. 2 reveals that this U-shaped configuration is developed such that the upward extending portion 100 of band 98 is insertable within the retainer cavity 90 of lid 18. To achieve an engagement within cavity 90 while still permitting removability of the gasket 92, two angularly downwardly extending fins 102 and 104 are coextruded with band 98. These fins 102 and 104 preferably are formed of a flexible material such as the thermoplastic rubber employed for the ring seal portion 94. Additionally coextruded with band 98, fins 102 and 104, and ring seal portion 94 is an annular flap 106. Flap 106 preferably is formed of a flexible polymeric material such as the earlier-identified thermoplastic rubber. The flap serves the dual functions of providing a secondary seal for the lid 18 and as a readily accessible grasping portion for removing the gasket 92 as part of the process of refurbishing lid 18 for additional use. Preferably, the cavity 96 of ring seal portion 94 is filled with a foam material, for example of a variety marketed under the trade designation "Santoprene" by Advanced Elastomer Systems (supra). "Vyram" and "Santoprene" are blends of monoolefin copolymer rubber and polyolefin resin. See in this regard, U.S. Pat. Nos. 4,898,760; 4,130,535; 5,070,111; 5,192,586; and 5,393,796.

Returning to FIG. 2, the gasket 92 is revealed in its operative orientation wherein ring seal portion 94 is compressed within the cavity 74 by upwardly disposed edge 76 of the container 12. Secondary sealing of the lid 18 to the container 12 is achieved by the flap 106 which is seen to flexibly engage the annular ledge portion 82 of container upper portion 78. Within the retainer cavity 90, upwardly extending portion 100 of retainer band 98 is seen to be compressibly engaged against one side of cavity 90 by the flexural engagement of fins 102 and 104 within the cavity.

FIG. 2 further shows a cross-section of clamp ring 42 including band portion 46, crest 52, and sides 48 and 50, causing a compressive engagement of the lid 18 with the top portion 78 of container 12.

Upward extension 88 of the ring band 28 is of extent both for the purpose of establishing enhanced strength or stiffness at that region and for the purpose of developing an annular stacking ledge 108 to facilitate the placement of one lid upon another for shipping purposes as well as for stacking the assemblies 10 themselves.

Figure 4:
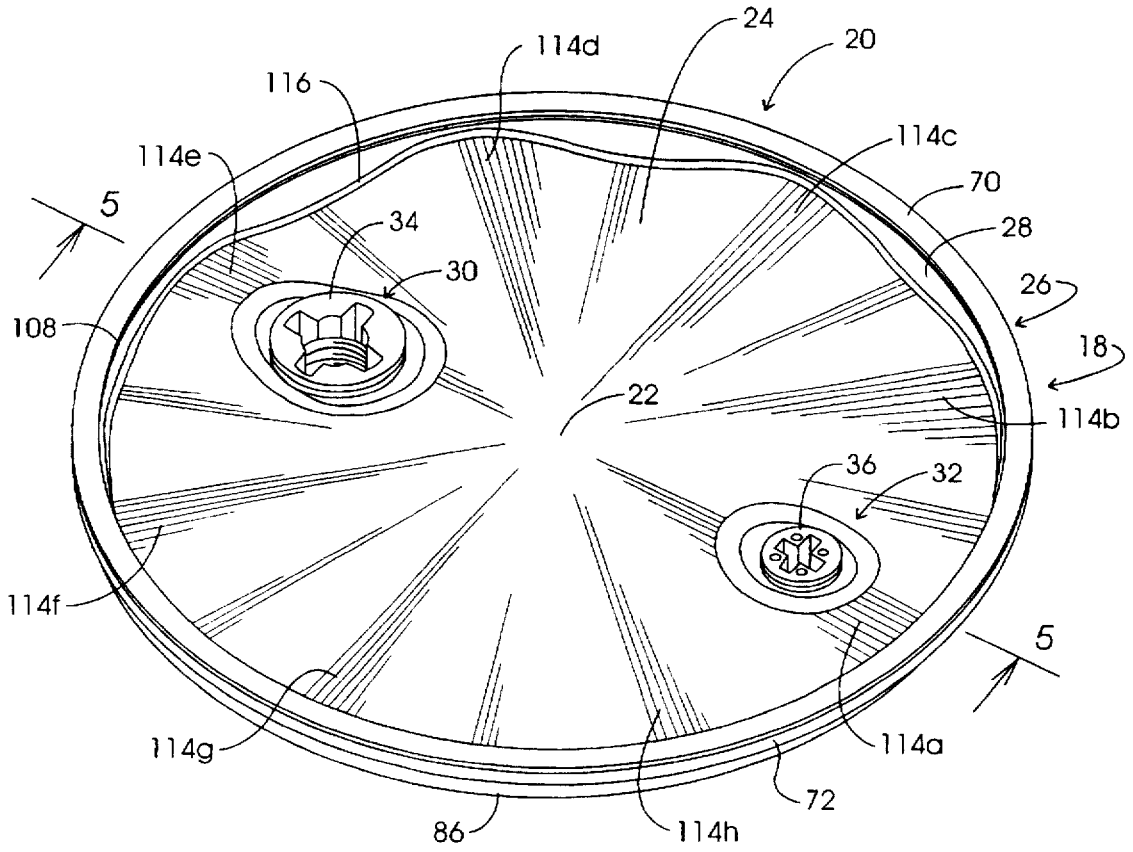
FIG. 4 is a perspective view of a lid configured according to the invention.

Looking to FIG. 4, a perspective view of the lid 18 is shown. In the figure, intermediate region 24 is shown being formed of an even number, in this case eight, waves, each of curved cross-section and defining a sequence of successively occurring crests, **114*a*–114*h*, as well as corresponding troughs, the distance between the former trough and a crest generally representing the amplitude of the waves which increases radially outwardly from the center 22 of the lid until ring band 28 is encountered. In the interest of drawing clarity, the rounded transition as the intermediate region 24 converges into ring band 28 is represented by the dual borderlines represented at 116. Without such drawn borderlines 116, the sinewave form of conjunction between ring band 28 and the intermediate region 24 would not be perceived readily. The amplitudes of these waves commence from a zero value at lid center 22 and the overall profile of the central region is that of a dome which functions to enhance the structural integrity of lid 18**.

Figure 5:
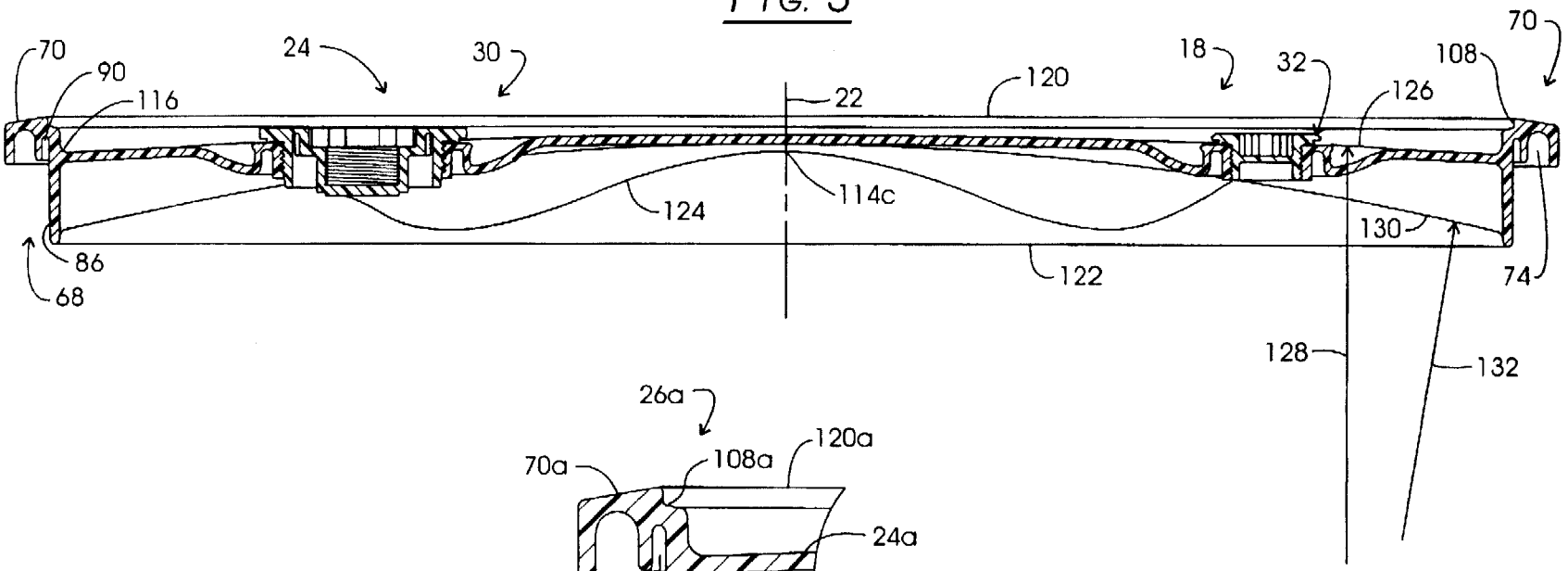
FIG. 5 is a sectional view of the lid structure of the invention taken through the plane 5—5 seen in FIG. 4.

Looking to FIG. 5, a cross-section taken from FIG. 4 is revealed which shows the profile or uppermost edge of lid rim 70 at 120, the center of the lid as an axis 22, the lower periphery 122 of downward extension 86 of ring band 28, and the lower profile of a portion of the sinusoidal or waveshaped intermediate region 24 as it intersects ring band 28 as represented at line 124. The bottom surface of crest **114*c* also is identified as aligned with the center axis 22 for the purposes of this drawing. The shallow dome configuration of the intermediate section 24 is identified by arc 126 at a radius identified as 128. Arc 126 lies along the upwardly disposed surfaces of the crests 114*a*–114*h*. Correspondingly, a next arc represented at line 128 is disposed along the lower surfaces of the troughs of each of the eight waves of lid 18 which lie along a radius 132 of lesser extent than radius 128. The distance parallel with axis 22 between radii 128 and 132 represents the varying amplitude, A, of the waves within intermediate region 24. It may be observed that the amplitude A varies from essentially a zero valuation at axis 22 to a maximum valuation at ring band 28. In general, the radius 128 will have a value of about 200 inches and radius 132** a value of about 40 inches. In one embodiment, those values respectively are 216.97 inches and 44.51 inches.

Figure 6:
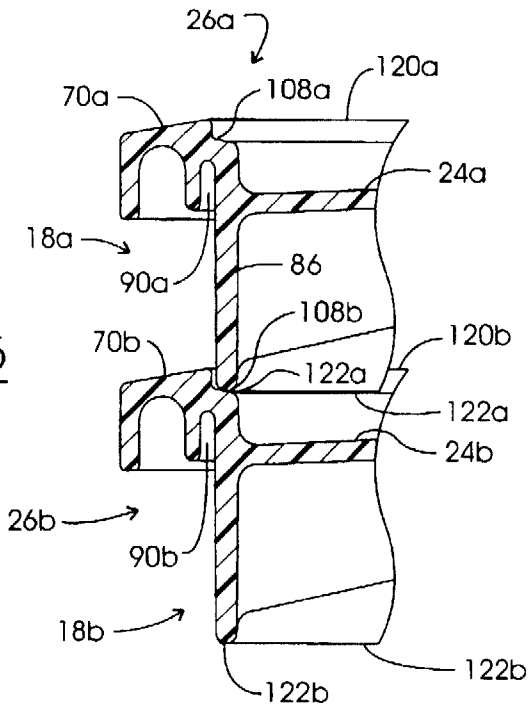
FIG. 6 is a partial sectional view of two lids structured according to the invention arranged in stacked relationship.

Referring to FIG. 6, the stackability of lids 18 is illustrated. An important aspect of the industrial lids at hand is that they may be readily shipped, and thus be stackable. This is achieved through the integration of the stacking ledges 108. In FIG. 6, an upper lid is shown with the above discussed identifying numeration in combination with the suffix "a". Correspondingly, a next lower lid 18 is shown in stacking relationship with the identifying numeration being combined with the suffix "b".

Lid 18 has been evaluated by computer modeling employing a finite element approach. That approach corresponded with earlier computer modeling of two operationally acceptable plastic molded lids employing a gusset-type reinforcement. In addressing the modeling involved, it was observed that the intermediate region 24 of lid 18 may be described as incorporating a radially swept wave. In developing a computer model, the surfaces of the lid are created in dimensional space, initial considerations being made with a two-dimensional approach. In this regard, looking to FIG. 7, a local Cartesian coordinate system is defined such that its origin lies on the axis of symmetry 140 at a location at the bottom of the lid's skirt, i.e. profile 122. An upper Arc 1 at a radius R1 from center C1 at axis 140 is established. This corresponds to the Arc 126. Next, an Arc 2 at a radius R2 is established, the radius being developed from center C2. The surfaces of the intermediate region 24 are generated by "lofting" a surface through curves defining the peaks and valleys of the waves. Lofting a surface is a method of fitting a surface to a series of curves. Arcs 1 and 2 in FIG. 7 define the curvature of the lid intermediate region surface at a wave peak and valley, respectively. To generate the surface, these curves are copied and rotated to their proper orientation prior to surface creation by lofting. The lid design relates the radius of curvature of the lid's intermediate region 24 through the amplitude of the wave at its intersection with the ring band 28. The relationship between the two Arcs can be described using the equation of the circle as follows:

$$(x-x_c)^2+(y-y_c)^2=R^2 \quad (1)$$

Bung hole assemblies 30 and 32 are not considered in the analysis. Geometric relationships are established with the following definitions:

| | |
|---|---|
| A | Amplitude of wave |
| $R_1$ | Radius of Arc 1 |
| $R_2$ | Radius of Arc 2 |
| $x_{R11}$, $y_{R11}$ | Point of intersection of Arc 1 with symmetry axis |
| $x_{R12}$, $y_{R12}$ | Point of intersection of Arc 1 with skirt |
| $x_{R1c}$, $y_{R1c}$ | Coordinates of center point of Arc 1 |
| $x_{R21}$, $y_{R21}$ | Point of intersection of Arc 2 with symmetry axis |
| $x_{R22}$, $y_{R22}$ | Point of intersection of Arc 2 with skirt |
| $x_{R2c}$, $y_{R2c}$ | Coordinates of center point of Arc 2 |

Figure 7:
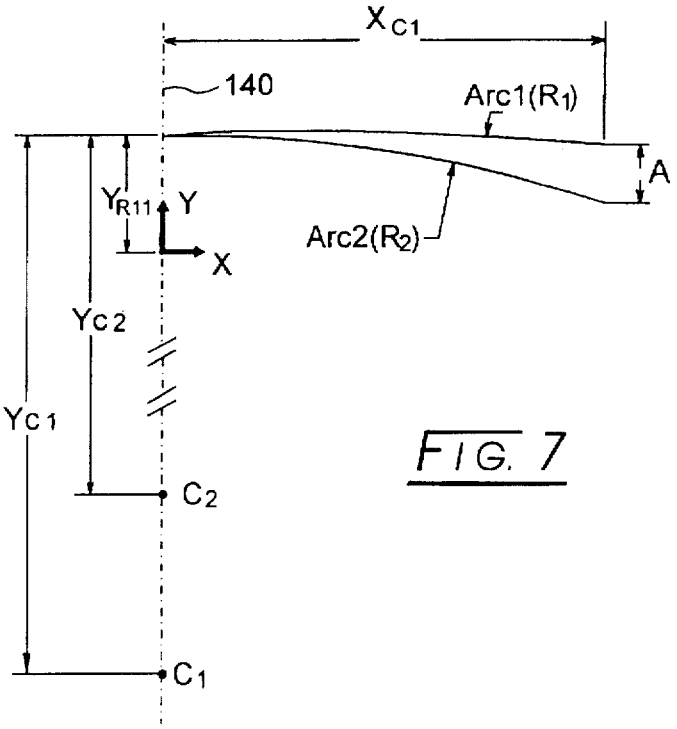
FIG. 7 illustrates a two-dimensional commencement of the mathmatical modeling of the lid of the invention.

The Arc centers C1 and C2 are constrained to lie on the axis of symmetry 140 of the lid. FIG. 7 shows that these Arcs terminate at their intersection with ring band 28 ($x_{C1}$). The values of the amplitude, A, and radius, R1, are given. R2 may be related to R1 through equations utilizing the remaining variables.

For Arc 1, $x_{R11}$, $y_{R11}$, $x_{R12}$, and $x_{R1C}$ are given. The value of $y_{R1C}$ can be found as follows:

$$y_{R1C}=y_{R11}-R_1 \tag{2}$$

Substituting variables for Arc 1 into Equation (1) yields:

$$(x_{R12}-x_{R1C})^2+(y_{R12}-y_{R1C})^2=R_1^2 \tag{3}$$

Substituting Equation (2) into (3) and recognizing that $x_{R1C}=0$ yields:

$$x_{R12}^2+[y_{r12}-(y_{R12}-R_1)]^2=R_1^2 \tag{4}$$

For Arc 2, $x_{R21}$, $y_{R21}$, $x_{R22}$, and $x_{R2C}$ are known. The value of $y_{R22}$ is related to $y_{R12}$ through the wave amplitude as:

$$y_{R22}=y_{R12}-A \tag{5}$$

The value of $y_{R2C}$ can be determined as;

$$y_{R2C}=y_{R11}-R_2 \tag{6}$$

As with Arc 1, substitute the variables defining Arc 2 into equation (1).

$$(x_{R22}-x_{R2C})^2+(y_{R22}-y_{R2C})^2=R^2 \tag{7}$$

Substituting equations (5) and (6) into (7) and recognizing that $x_{R2C}=0$ yields $$x_{R22}^2+[(y_{R12}-A)-(y_{R22}R_2)]^2=R_2^2 \tag{8}$$

The general equations which define the relationship between the two curves can now be found. Solving equation (4) for $y_{R12}$ and equation (8) for $R_2$ yields:

$$y_{R12}=\sqrt{R_1^2-x_{R12}^2}+y_{R11}-R_1 \tag{9}$$

and $$R_2=\frac{2y_{R11}y_{12}+2A(y_{R12}-y_{R11})-x_{R22}^2-y_{R11}^2-y_{R12}^2-A^2}{2(y_{R12}-y_{R11}-A)} \tag{10}$$

Equations 9 and 10 state that given starting values of amplitude A, curvature R1, skirt radius $x_{R12}$, $x_{R22}$, and the midpanel dome center pont $y_{R11}$ and $y_{R2}$, the second curve defining the lid curvature at a valley in the wave is completely defined.

For comparative purposes, the lid geometry elected was based upon a lip and skirt configuration employed with another analysis for a polymeric lid demonstrating acceptable performance and illustrated in connection with FIGS. 18 and 19. This preprocess approach provided the following parameters (values given in inches) for base analysis:

Wave amplitude A=1.25

Radius of the curvature for Arc 1: $R_1$=188.368

Skirt Radius: $x_{R12}=x_{R22}$=9.612

Dome Counter Point: $y_{R11}=y_{R21}$=1.35.

Figure 8:
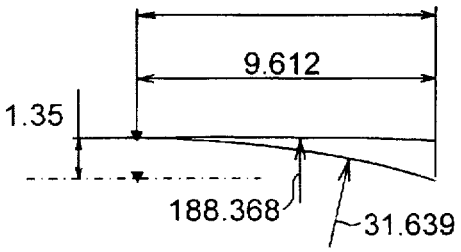
FIG. 8 is a two-dimensional representation showing curve definition for the computerized model of the lid of the invention.

Using Equation (9), $y_{R12}$ is found to be 1.1046. Applying this result to equation (10) results in a value for the curvature $R_2$ of Arc 2 as 31.639. These initial variables are seen illustrated in FIG. 8.

Figure 9:
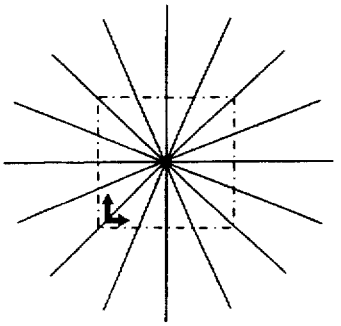
FIG. 9 illustrates a rotation of the curves of FIG. 8 to orient them in conjunction with the number of waves of the lid intermediate region.
Figure 10:
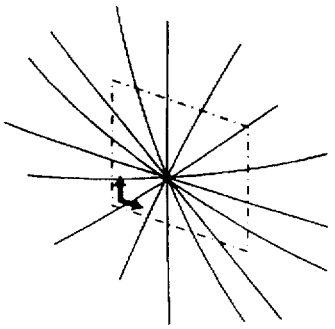
FIG. 10 is an isometric view of a three-dimensional rotation of the subject of FIG. 8.
Figure 11:
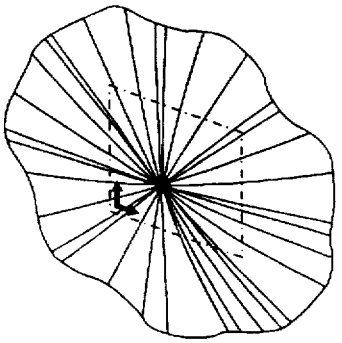
FIG. 11 is an isometric view of a surface created by lofting as a modeling procedure for the lid of the invention.

FIG. 9 illustrates a next step in the evolution of the computer model of lid 18. In FIG. 9, the two-dimensional representation of FIG. 7 is rotated. Next, as seen in FIG. 10, the thus-rotated two-dimensional model then is moved into three-dimensional space. A mathmatically lofted surface then is generated as represented in FIG. 11.

Figure 12:
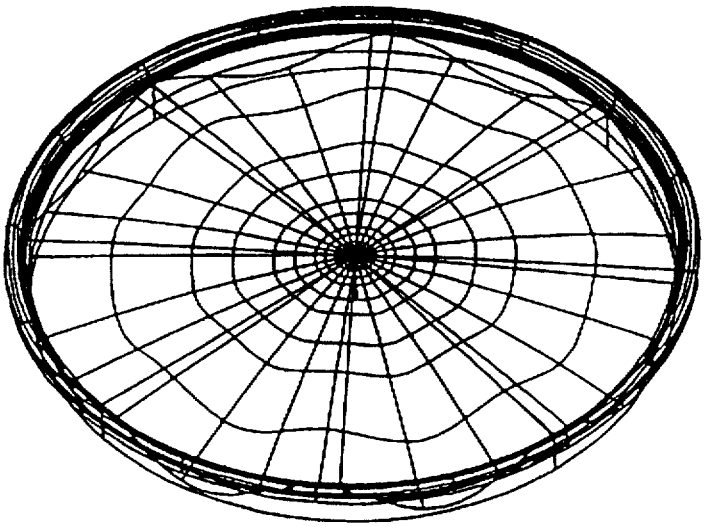
FIG. 12 is a perspective illustration of a complete mid-plane model developed in conjunction with an analysis of the lid of the invention.

I-DEAS™ Master Series Simulation Software Version 1.3C was employed for the instant analysis. This software is available from Structural Dynamics Research Corporation of Milford, Ohio and was employed for geometrical and finite element modeling. Because of the thin wall structure at hand, the lid design was modeled for the analysis using thin shell finite elements. Accurate modeling of such structures requires that those elements be constructed on mid-plane geometry. Mid-plane surfaces are surfaces which are created by interpolating surface midway between two parallel surfaces, in this case, midway between the top a surface of the intermediate region of the lid and the bottom surface thereof In cases where the two surfaces are not exactly parallel, the interpolation is a best fit approximation. Shell elements created on such mid-plane surfaces are assigned a thickness of the original two parallel surfaces defining the lid geometry. FIG. 12 illustrates the mid-plane surface topography which was developed.

Mixed finite element meshes of mapped and pre-meshed surfaces were generated on the mid-plane geometry. For ease of mesh generation, only half of the lid geometry was meshed. The resultant mesh then was copied and rotated 180° to complete the mesh of the entire lid.

Figure 13:
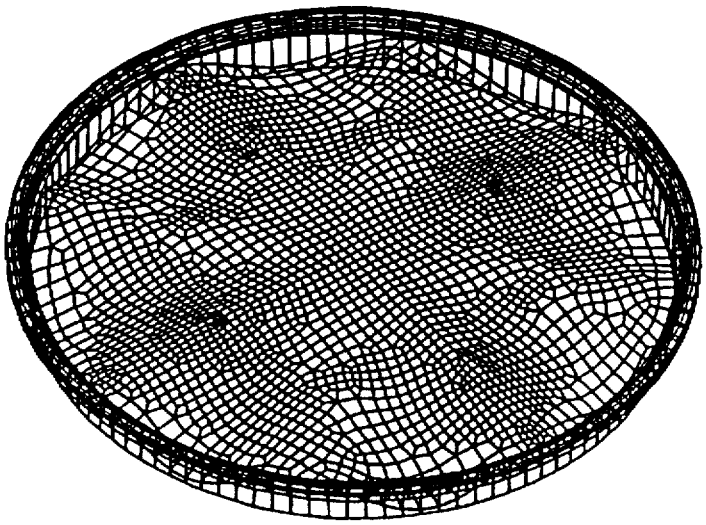
FIG. 13 is an illustration of a finite element mesh representation of the model of the lid of the invention.

To prevent the lip or outer rim structure 26 from collapsing under load, a ring of four-node solid elements were generated inside the circumference of that region lip. For all analyses performed in the study, the mapping of the lip and skirt (ring band) configuration was identical except where the mesh density was doubled due to the increased complexity of the surface topography of a design model which incorporates 16 waves. An illustration of a final mesh typical to this analysis is shown in FIG. 13. As can be seen, the rim or lip and the skirt or ring band regions of the lid have been mapped (or regularly meshed) while the mesh on the mid panels or intermediate region has been free (or irregularly) meshed. The model in FIG. 13 corresponds to the lid with eight waves per mid panel or intermediate region section. Inasmuch as the model at hand was based upon mid-plane geometry, the shell elements had been assigned different values of thickness depending upon the region where they exist. For example, at the lip or rim region, a thickness of 0.133 in. was assigned. The skirt region or that corresponding with ring band 28 was assigned a thickness of 0.156 in. and the intermediate region or center panel was assigned an initial thickness of 0.14 in. In the latter regard, varying thicknesses of the intermediate region or center panel were utilized as part of the analysis. In this regard, the center panel values were modeled at element thicknesses of 0.13 in., 0.14 in., and 0.15 in. All elements were considered to have the same isotropic material properties. The material properties were that for high density polyethylene. A Young's modulus of $2.17\times10^5$ psi and a Poisson's ratio of 0.4 were assigned to all elements. The models analyzed were as follows:

Models investigating wave contributions to structural strength.

1. 8 wave midpanel
2. 12 wave midpanel
3. 16 wave midpanel

Models investigating contribution of midpanel wall thickness. (8 waves for all models).

1. wall thickness=0.13"
2. wall thickness=0.14"
3. wall thickness=0.15"

Models examining effect of wave amplitude. (8 waves for all models).

1. amplitude A=0.75"
2. amplitude A=1.0"
3. amplitude A=1.25"

Models examining the contribution of dome curvature (8 waves for all models).

1. $R_1$=188.368, amplitude A=1.25, Dome center point $y_{R11}$=1.35
2. $R_1$=1017.562, amplitude A=1.25, Dome center point $y_{R11}$=1.15
3. $R_1$=93.496, amplitude A=1.25, Dome center point $y_{R11}$=1.60.

Figure 18:
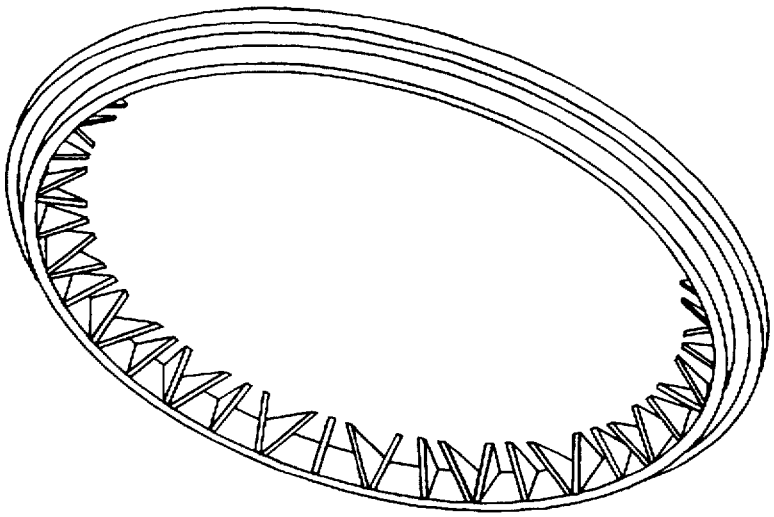
FIG. 18 is a perspective view of one lid design, the computer modeling of which is compared with the corresponding modeling of the lid of the invention.
Figure 19:
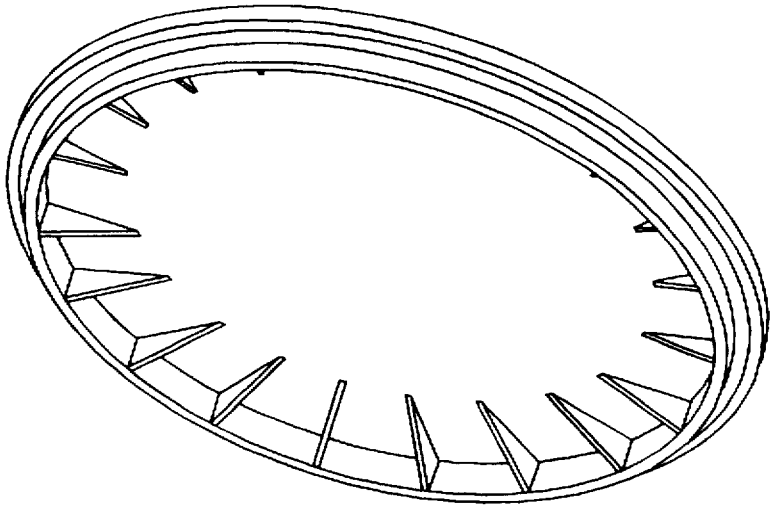
FIG. 19 shows another lid design, the computer modeling results of which are compared with those of the lid of the invention.

The boundary conditions modeled in the analysis were identical to those modeled in an analysis of successful molded plastic lids as represented at FIGS. 18 and 19. By imposing identical boundary conditions, the results from the analysis then could be compared with those of the analysis of the latter figures. The same boundary conditions were applicable inasmuch as all boundary conditions were applied to the lip or rim and skirt or ring band regions of the model. Identical meshing was applied in both cases which allowed for identical loads to be applied. For all analyses, each lid was considered to be rigidly clamped over 40° of the lid's circumference. Exterior nodes along a 40° portion of the circumference were affixed in all coordinate directions. This is an idealized situation which can be perceived as if a form-fitting clamping fixture were holding a 40° section of lid.

Figure 14:
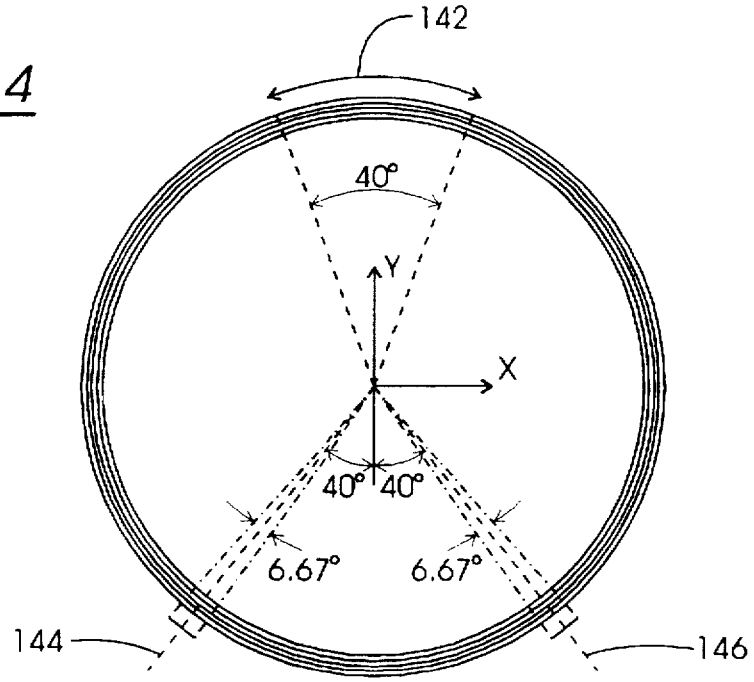
FIG. 14 is a diagrammatic view showing a twisting load boundary condition employed in analyzing the lid of the invention.

FIG. 14 illustrates the first boundary condition set (Set 1). The lid was considered to be clamped along 40° of circumferential Arc as represented at arrow 142. A twisting load was imposed by placing two equal but opposing distributed forces of 5 lbf, 80° apart as shown in the figure adjacent dotted radii 144 and 146. To avoid high localized stress, these forces were placed on nodes and distributed over a 6.67 degree portion of the circumference along the underside of the lip of the lid.

Figure 15:
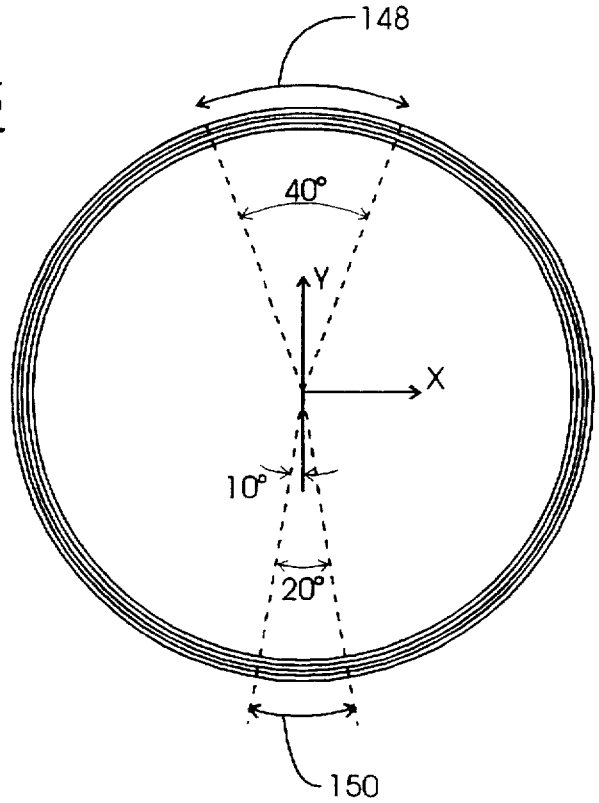
FIG. 15 is a diagrammatic view showing a positive Z axis bending load boundary condition employed in analyzing the lid of the invention.

Boundary set 2 is represented in conjunction with FIG. 15. As before, exterior nodes along a 40° portion of the circumference were affixed in all coordinate directions. This region is represented by the arrow 148. A net force of 5 lbf was placed on a 20° portion of the circumference on the underside of the lip of the lid. This 20° portion is represented at arrow 150. The direction of action for this distributed load was in the positive, Z, coordinate.

Figure 16:
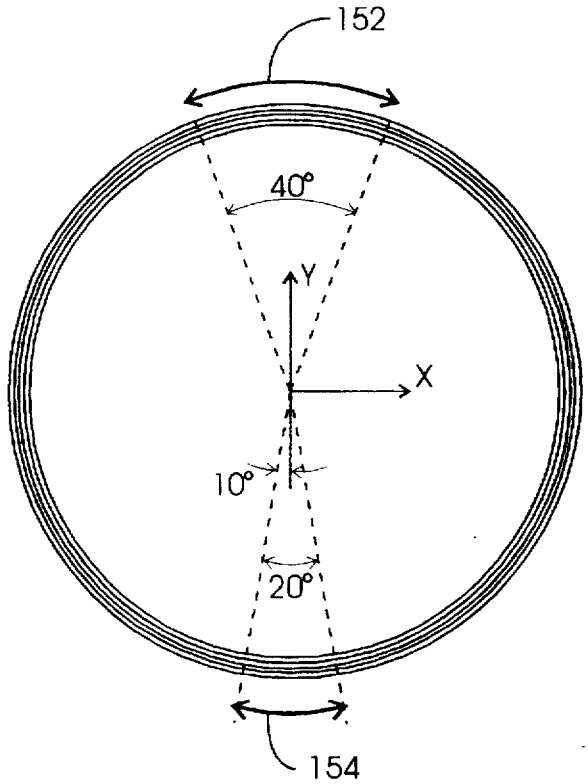
FIG. 16 is a diagrammati view showing a 30° oblique load boundary condition employed in analyzing the lid of the invention.

Looking to FIG. 16, boundary set 3 is illustrated. As before, as represented at arrow 152, exterior nodes along a 40° portion of the circumference of the lid were fixed in all coordinate directions. A 30° oblique load as defined from the Z-axis was applied with a net force of 10 lbf. This load was distributed over a 20° portion of the circumference as represented by arrow 154. In this regard, the applied load may be considered in conjunction with two forces, one vertically downwardly into the lid, and another horizontally toward the center of the lid, those forces defining a vector at an angle of 30° from vertical.

Figure 17:
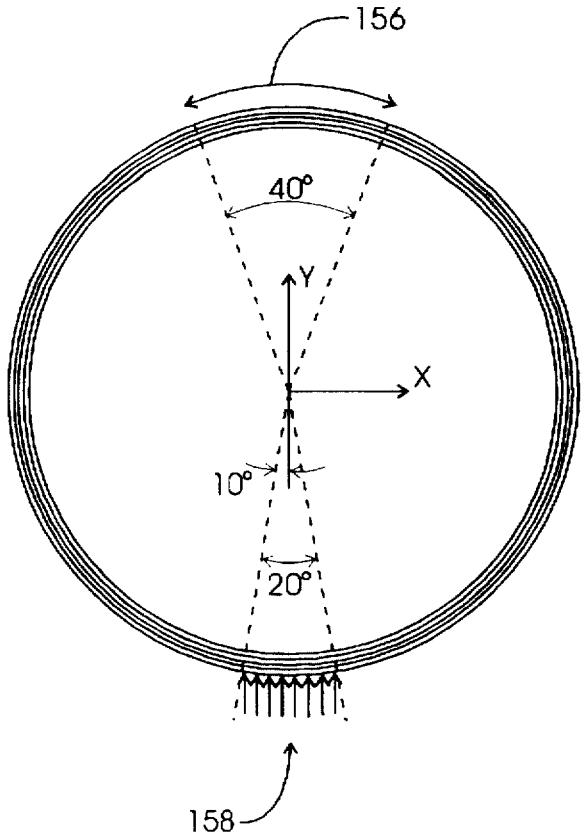
FIG. 17 is a diagrammatic view showing a buckling load boundary condition employed in analyzing the lid of the invention.

Referring to FIG. 17, the conditions for boundary set 4 are illustrated. As before, exterior nodes along a 40° portion of the circumference of the lid were fixed in all coordinate directions. This region is represented at arrow 156. For this boundary set, a 5 lbf load acting in the positive y-coordinate direction was applied. This force was distributed along a 20° portion of the circumference as represented by the arrow set 158. The distribution of this force was defined as acting on the outside surface of the lid lip and skirt areas of this 20° segment.

The results of the analysis are summarized in the tables to follow. Von Mises stresses resulting from the prescribed loads were computed and maximum values thereof are set forth in the tabulations. Von Mises stress often is called the effective stress and is represented in equation form as $$\sigma = \left[ \frac{(\sigma_1 - \sigma_2)^2 + (\sigma_2 - \sigma_3)^2 + (\sigma_1 - \sigma_3)^2}{2} \right]^{1/2} \quad (11)$$

where $\sigma_1$, $\sigma_2$, and $\sigma_3$ are the stresses in the principal directions. Maximum displacement in inches for each of the boundaries of the four boundary sets identified in the tables as "load case" are set forth along with the maximum von Mises stress in pounds per square inch.

TABLE 1

Variable Number of Waves, Analysis Results

| Model # Waves | Load Case | Max. Disp. (inch) | Von Mises Stress (psi) |
|---|---|---|---|
| 8 | 1 | 0.108 | 238 |
| | 2 | 0.470 | 311 |
| | 3 | 0.795 | 533 |
| | 4 | 0.00634 | 21.9 |
| 12 | 1 | 0.104 | 277 |
| | 2 | 0.507 | 400 |
| | 3 | 0.858 | 675 |
| | 4 | 0.00627 | 18.5 |
| 16 | 1 | 0.0995 | 346 |
| | 2 | 0.5030 | 530 |
| | 3 | 0.9110 | 936 |
| | 4 | 0.00508 | 23.2 |

Looking to Table 1, an evaluation of the waved lid with respect to the number of waves provided and the boundary set or load case is summarized. Data of Table 1 supports a preferred embodiment employing eight waves. In particular, it may be observed from Table 1 that increasing the number of waves from 8 to 12 and then to 16 provided no particular advantage to the structural strength of the lid when subjected to the four load conditions. In fact, the displacements and stresses due to each boundary condition set increased as the number of waves increased. Minor exception occurs for the lid model incorporating 12 waves. The displacements for this model when subjected to a buckling load actually decreased slightly. However, this possible benefit is negligible compared to the strength provided against the other lid conditions.

Table 2 below summarizes the results for each of the four boundary condition sets or load cases where wall thickness is varied as above-described from 0.13 in. to 0.15 in. The analysis shows that strains and stresses decrease for all the configurations as the center panel or intermediate region 24 wall thickness increases. This would suggest that increasing the center panel thickness as much as possible within mold and geometrical constraints would be beneficial to overall stiffness and the like. A limitation on reasonable values of wall thickness would be that the lid must retain some pliability so that it can be relatively easy to remove from a drum. With the above considerations in mind, an increase in the center panel thickness will provide an enhancement of stiffness at the lid/drum interface. In practical performance, the lid has been found to operate satisfactorily at a thickness of 0.125 in.

TABLE 2

Variable Wall Thickness, Analysis Results

| Model | Load Case | Max. Disp. (inch) | Von Mises Stress (psi) |
|---|---|---|---|
| th = 0.13" | 1 | 0.0108 | 280 |
| | 2 | 0.0538 | 422 |
| | 3 | 0.0910 | 712 |
| | 4 | 0.00665 | 19.3 |
| th = 0.14" | 1 | 0.01080 | 277 |
| | 2 | 0.04700 | 400 |
| | 3 | 0.07950 | 675 |
| | 4 | 0.00634 | 18.5 |
| th = 0.15" | 1 | 0.0101 | 274 |
| | 2 | 0.0480 | 381 |
| | 3 | 0.0812 | 643 |
| | 4 | 0.00592 | 17.8 |

Table 3 below summarizes the results of varying the wave amplitude for each of the four boundary condition sets for each such load case. It may be observed from the summary of Table 3 that as wave amplitude increases, model stiffness improves in response to twisting, bending, and oblique loading. However, as the wave amplitude increases, stiffness to buckling loading decreases. Larger values of wave amplitude provide a "crumple" effect by decreasing the stiffness of the lid in response to lateral loads. However, increasing the wave amplitude improves the lid's stiffness to the other loads modeled. These types of loads primarily involve bending across the panel face. Increased wave amplitude will provide added stiffness to this kind of loading. However, the benefit of a large value of amplitude must be weighed against the increase in material cost. With such a constraint in mind, it is opined that the amplitude should be made as large as reasonably possible.

TABLE 3

Variable Wave Amplitude, Analysis Results

| Model | Load Case | Max. Disp. (inch) | Von Mises (max) Stress (psi) |
|---|---|---|---|
| A = 0.75" | 1 | 0.153 | 288 |
| | 2 | 0.768 | 409 |
| | 3 | 1.300 | 691 |
| | 4 | 0.00574 | 14.6 |
| A = 1.0" | 1 | 0.131 | 242 |
| | 2 | 0.612 | 368 |
| | 3 | 1.040 | 619 |
| | 4 | 0.00681 | 15.8 |
| A = 1.25" | 1 | 0.108 | 238 |
| | 2 | 0.470 | 311 |
| | 3 | 0.795 | 533 |
| | 4 | 0.00634 | 21.9 |

FIGS. 18 and 19 show a "radial rib" lid design which was computer modeled with equivalent data. These lids performed satisfactorily. The structuring of the lid of FIG. 18 is one of alternating V-shaped and shorter ribs, while that at FIG. 19 employs lengthier ribs. For the same boundary condition sets for load cases 1–4, the data set forth in Table 4 was developed. As before, both the displacement and von Mises stresses are maximums. This data, when compared to the results of the eight wave design as summarized in connection with Table 1 shows that the wavelength concept performed significantly better than either of the rib designs of FIGS. 18 and 19. In this regard, the values for stress and displacement for the wave concept are up to less than 50% of those experienced for the rib designs.

TABLE 4

Analysis of Radial Rib Design

| | Design FIG. 18 | | Design FIG. 19 | |
|---|---|---|---|---|
| Load Case | Max. Disp. (inch) | von Mises Stress (psi) | Max. Disp. (inch) | von Mises Stress (psi) |
| Case 1 (Twisting) | 0.2060 | 400.00 | 0.1840 | 543.00 |
| Case 2 (Pos. Z Bending) | 1.3300 | 1330.00 | 1.1400 | 1190.00 |
| Case 3 (30° Oblique) | 1.2800 | 1290.00 | 1.1000 | 1150.00 |
| Case 4 (Buckling) | 0.0662 | 76.60 | 0.0436 | 64.80 |

Since certain changes may be made in the above apparatus without departing from the scope of the invention herein involved, it is intended that all matter contained in the above description or shown in the accompanying drawings shall be interpreted as illustrative and not in a limiting sense.

We claim:

1. A molded lid for a container having a top structure with an upwardly disposed edge and an inwardly disposed wall surface, comprising:

a lid top portion having a central region disposed about a lid center axis and an intermediate region extending therefrom to an outer periphery locatable adjacent said container top structure, an annular rim structure integrally formed with said top portion at said outer periphery having a concave annular sealing cavity for receiving said container upwardly disposed edge in sealing relationship and having a ring band locatable in adjacency with said inwardly disposed wall surface and extending downwardly therealong when said lid is positioned upon said container; and said intermediate region being configured as a sequence of a predetermined number of waves, each of curved cross-section and defining successively occurring crests and troughs exhibiting amplitudes therebetween increasing in amplitude value radially outwardly from said lid center axis toward and having a predetermined maximum amplitude value at said ring band, said wave crests defining a shallow outwardly extending dome.

2. The molded lid of claim 1 in which:

said predetermined number of waves is an even integer; and said intermediate region is formed having diametrically oppositely disposed bung orafices located at a said crest.

3. The molded lid of claim 1 in which said predetermined number of waves is eight.

4. The molded lid of claim 1 in which said annular rim structure extends above said top portion to define an annular stacking ledge configured for receiving the said ring band of another said lid in stacking realsonship.

5. The molded lid of claim 1 in which:

said lid top portion shallow dome has an upwardly disposed surface at a radius of about 200 inches.

6. The molded lid of claim 1 in which:

each said wave trough extends radially outwardly from said lid center axis substantially along a first radius of predetermined extent;

each said wave crest extends radially outwardly from said lid center axis substantially along a second radius of predetermined extent greater than the predetermined extent of said first radius.

7. The molded lid of claim 6 in which said predetermined extent of said first radius is about 40 inches; and said predetermined extent of said second radius is about 200 inches.

8. A molded lid for a container having a top structure with an upwardly disposed edge, comprising:

a lid top portion having a lid center and an intermediate region extending therefrom to an outer periphery locatable adjacent said container top structure;

an annular rim structure integrally formed with said top portion at said outer periphery, including an annular lid rim having a concave annular sealing cavity for receiving said container upwardly disposed edge in sealing relationship and a retainer cavity located in adjacency with said sealing cavity; and a gasket having a ring seal portion slidably insertable within said sealing cavity, a retainer band fixed to said ring seal and extensible in sliding, compressive engagement within said retainer cavity.

9. The molded lid of claim 8 in which said retainer band is formed of polymeric material having a generally U-shaped configuration.

10. The molded lid of claim 8 in which said gasket retainer band includes at least one engaging fin extending outwardly therefrom and compressibly engageable within said retainer cavity.

11. A molded lid for a container having a top structure with an upwardly disposed edge and an inwardly disposed wall surface, comprising:

a lid top portion having a central region disposed about a lid center and an intermediate region extending therefrom to an outer periphery locatable adjacent said container top structure;

an annular rim structure integrally formed with said top portion at said outer periphery, having a ring band locatable in adjacency with said inwardly disposed wall surface, and an annular lid rim with a concave annular sealing cavity for receiving said container upwardly disposed edge in sealing relationship and a retainer cavity located in adjacency with said sealing cavity;

a gasket having a ring seal portion slidably insertable within said sealing cavity, a retainer band fixed to said ring seal and extensible in sliding, compressive engagement within said retainer cavity; and said intermediate region being configured as a sequence of a predetermined number of waves, each of curved cross-section and defining successively occurring crests and troughs exhibiting amplitudes therebetween increasing in amplitude value radially outwardly from said lid center toward and having a predetermined maximum amplitude value at said ring band.

12. The molded lid of claim 11 in which:

said predetermined number of waves is an even integer; and said intermediate region is formed having diametrically oppositely disposed bung orafices located at a said crest.

13. The molded lid of claim 11 in which:

said lid top portion is generally configured as a shallow dome having an upwardly disposed surface at a radius of about 200 inches.

14. The molded lid of claim 11 in which said retainer band is formed of polymeric material having a generally U-shaped configuration.

15. The molded lid of claim 11 in which:

said container top structure includes an annular ledge portion extending outwardly from said inner surface;

said retainer cavity is of annular configuration and is spaced inwardly from said annular sealing cavity; and said gasket includes an annular flap extending from said retainer band engageable with said ledge portion to provide a secondary seal when said lid is in a closing orientation upon said container and is accessible for grasping to effect removal of said gasket from said lid when said lid has been removed from said container.

16. The molded lid of claim 11 in which said polymeric gasket retainer band includes at least one engaging fin extending outwardly therefrom and compressibly engageable within said retainer cavity.

17. A molded lid for a container having a top structure with an upwardly disposed edge, an inwardly disposed wall surface and an annular ledge portion extending outwardly from said inwardly disposed wall surface, comprising:

a lid top portion having a lid center and an intermediate region extending therefrom to an outer periphery locatable adjacent said container top structure;

an annular rim structure integrally formed with said top portion at said outer periphery, including an annular lid rim having a concave annular sealing cavity for receiving said container upwardly disposed edge in sealing relationship and an annular retainer cavity located in adjacency with and spaced inwardly from said sealing cavity; and a gasket having a ring seal portion slidably insertable within said sealing cavity, a retainer band fixed to said ring seal and extensible in sliding, compressive engagement within said retainer cavity, said polymeric gasket further including an annular flap extending from said retainer band engageable with said ledge portion to provide a secondary seal when said lid is in a closing orientation upon said container and is accessible for grasping to effect removal of said gasket from said lid when said lid has been removed from said container.

18. The molded lid of claim 17 in which said gasket retainer band includes at least one engaging fin extending outwardly therefrom and compressibly engageable within said retainer cavity.

19. The molded lid of claim 18 in which:

said polymeric gasket ring seal portion is formed as an extruded flexible polymeric skin having a flexible foamaceous core;

said retainer band is formed of a co-extruded stiff polymeric material having a generally U-shaped cross-seciton; and said fin is formed of a co-extruded flexible polymer.

* * * * *